US008123624B2

(12) United States Patent
Caldwell

(10) Patent No.: US 8,123,624 B2
(45) Date of Patent: Feb. 28, 2012

(54) SHOT MONITORING WATCH

(76) Inventor: Theodore Weissenburger Caldwell, Laguna Beach, CA (US)

( * ) Notice: Subject to any disclaimer, the term of this patent is extended or adjusted under 35 U.S.C. 154(b) by 437 days.

(21) Appl. No.: 11/243,699

(22) Filed: Oct. 6, 2005

(65) Prior Publication Data

US 2006/0199659 A1 Sep. 7, 2006

Related U.S. Application Data

(60) Provisional application No. 60/657,999, filed on Mar. 3, 2005.

(51) Int. Cl.
*A63B 57/00* (2006.01)

(52) U.S. Cl. ..... 473/221

(58) Field of Classification Search ..... 473/231–234, 473/221–227

See application file for complete search history.

(56) References Cited

U.S. PATENT DOCUMENTS

| | | | |
|---|---|---|---|
| 4,058,118 | A | 11/1977 | Stupay et al. |
| 4,222,569 | A | 9/1980 | DeMascolo |
| 4,269,193 | A | 5/1981 | Eckerle |
| 4,307,727 | A | 12/1981 | Haynes |
| 4,331,154 | A | 5/1982 | Broadwater et al. |
| 4,387,437 | A | 6/1983 | Lowrey et al. |
| 4,409,983 | A | 10/1983 | Albert |
| 4,987,900 | A | 1/1991 | Eckerle et al. |
| 5,261,412 | A | 11/1993 | Butterfield et al. |
| 5,406,952 | A | 4/1995 | Barnes et al. |
| 5,511,789 | A | 4/1996 | Nakamura |
| 5,551,437 | A | 9/1996 | Lotscher |
| 5,581,484 | A | 12/1996 | Prince |
| 5,588,919 | A | 12/1996 | Nakamura |

(Continued)

FOREIGN PATENT DOCUMENTS

DE 2846010 A 4/1980

(Continued)

OTHER PUBLICATIONS

Tekscan, FlexiForce(R) Sensors User Manual (Rev G), Feb. 5, 2009.

*Primary Examiner* — David L Lewis
*Assistant Examiner* — Eric M Thomas

(57) ABSTRACT

A golf swing monitoring system in the form of a one piece, wrist mounted unit which includes multi-function instrumentation with extremely high degrees of precision that monitors a plurality of critical components of a golf swing. In particular, motion sensors that discriminate finite changes in the timing and speed of the swing are disposed in a housing mounted on a wrist bank analogous to a common wrist watch or timepiece. A third component, user grip pressure, is simultaneously monitored and is similarly housed in the watch housing or casement. The detected parameters are displayed on a LCD which is part of the instrumentation. Finally the calculated values of the swing components can be saved in the memory of the invention. Subsequent swings are compared with those saved and the degrees to which later swings conform or deviate from the values for the saved swing are displayed. The subject invention has a skill level setting, 1 to 5 where 1 is the highest skill level, 5 the least. As the skill level setting approaches 1, there is a much narrower range of tolerance for deviations. Thus the match between the trial or subsequent swing and that saved in the memory of the subject invention must be nearly exact. Conversely, lower skill level settings are more forgiving and offer a wider tolerance for deviation from the saved values of the swing components.

13 Claims, 3 Drawing Sheets

U.S. PATENT DOCUMENTS

| | | | | |
|---|---|---|---|---|
| 5,655,223 | A | 8/1997 | Cozza | |
| 5,681,993 | A | 10/1997 | Heitman | |
| 5,688,183 | A * | 11/1997 | Sabatino et al. | 473/212 |
| 5,733,201 | A | 3/1998 | Caldwell et al. | |
| 5,771,492 | A | 6/1998 | Cozza | |
| 5,807,267 | A | 9/1998 | Bryars et al. | |
| 5,873,788 | A | 2/1999 | Hoffman | |
| 5,895,326 | A | 4/1999 | Cozza et al. | |
| 5,907,282 | A | 5/1999 | Tuorto et al. | |
| 6,037,703 | A | 3/2000 | Kambe et al. | |
| 6,196,932 | B1 * | 3/2001 | Marsh et al. | 473/223 |
| 6,224,493 | B1 * | 5/2001 | Lee et al. | 473/223 |
| 6,401,254 | B1 | 6/2002 | Boller | |
| 6,402,634 | B2 * | 6/2002 | Lee et al. | 473/223 |
| 6,491,647 | B1 | 12/2002 | Bridger et al. | |
| 6,772,442 | B2 | 8/2004 | Erker | |
| 6,913,559 | B2 | 7/2005 | Smith | |
| 7,101,287 | B1 | 9/2006 | Wagner | |
| 7,264,554 | B2 | 9/2007 | Bentley | |
| 7,341,561 | B2 | 3/2008 | Tanaka et al. | |
| 7,600,430 | B2 | 10/2009 | Palin et al. | |
| 7,780,541 | B2 | 8/2010 | Bauer | |
| 7,839,383 | B2 | 11/2010 | Li et al. | |
| 2001/0005695 | A1 * | 6/2001 | Lee et al. | 473/221 |
| 2001/0053720 | A1 * | 12/2001 | Lee et al. | 473/223 |
| 2002/0077189 | A1 | 6/2002 | Tuer et al. | |
| 2004/0216216 | A1 | 11/2004 | Terris et al. | |
| 2005/0113167 | A1 | 5/2005 | Buchner et al. | |
| 2005/0119036 | A1 * | 6/2005 | Albanna et al. | 463/7 |
| 2007/0010341 | A1 | 1/2007 | Miettinen et al. | |
| 2009/0163824 | A1 | 6/2009 | Ide et al. | |

FOREIGN PATENT DOCUMENTS

| | | | |
|---|---|---|---|
| JP | 08173586 | A | 7/1996 |
| JP | 10043350 | A | 2/1998 |

* cited by examiner

FIGURE 2a and 2b

200. Speed, Time, and Grip Arrows indicate whether swing is over (plus) or under (minus) the pre-settings 201. Large numerals are realized values for club head velocity (mph), elapsed time of t swing (m/secs) and the constancy of grip pressure exerted.

202. Handicap is self designated settings based on the user's estimated golfing expertise where 00 is best, 99 is worst.

203. Battery life is indicated by Illumination.

204. Audible Alert Volume indicator.

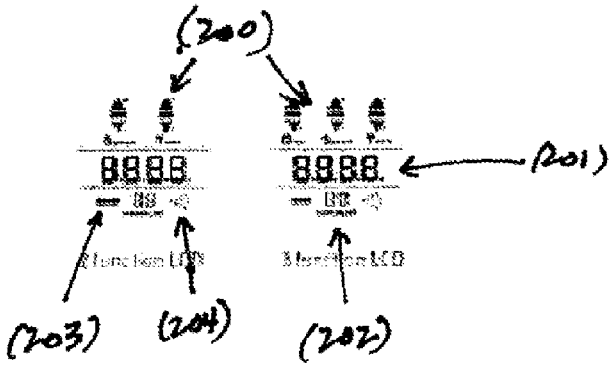

SHOT MONITORING WATCH

This application claims the benefit of the filing of U.S. Provisional Patent Application Ser. No. 60/657,999, entitled "SHOTWATCH", filed on Mar. 3, 2005, and the specification of that application is incorporated herein by reference.

As distinct from Sabatino et al (U.S. Pat. No. 5,688,183) the timing device and the swing velocity monitor is not dependent upon any audible signal for activation. Sabatino et al rely upon the noise or sound generated when the club strikes the ball and the recording or detection of the impact noise is the start time for speed and duration measurements. The present invention commences the measurement of swing speed and elapsed time of the swing beginning and ending when the club is perpendicular to the ground, in the first instance when the golfer pulls the club away from the ball (t=0) and secondly when the club makes contact with the ball, (t=+1)

As distinct from Sabatino et al (U.S. Pat. No. 5,688,183) the speed measurement (velocity) of the present invention is captured by an instrument worn on the wrist and is therefore synonymous with hand speed during the swing as opposed to Golf Club Velocity as specified in the title of the Sabatino et al invention.

Unique to the present invention is the skill level or HANDICAP setting which allows the user to specify his/her expertise in executing a golf swing. The present invention's rationale is a bio-feedback device that alerts the users if he/she has diverted from their pre-set swing parameters. As such, the higher the skill level or HANDICAP setting, the narrower the range of permitted divergence from the pre-set parameters. Such departures may be signaled by an audible signal, or a numeric representation of the watch face of the present invention.

BACKGROUND

1. Field of the Invention

This invention is directed to a golf training or teaching device, in general, and to such a training device in the form of a strap or band to be worn on the wrist of the user and which incorporates components and assemblies for measuring various parameters of the golf swing.

2. Prior Art Statement

Golf is a centuries old game with a long and well documented history. Until very recently, say the last 25 years, the equipment used was rather basic, if not primitive. Now that modern technology has come into the game, the equipment and apparatuses dedicated to the game are becoming more and more technologically advanced or sophisticated.

Globally there are over 100 million golfers. A significant percentage of this number are what are called "avid golfers" not just in terms of playing frequently, but also relative to the lengths to which they will go to improve their ability. There is some vague correlation between proficiency and satisfaction.

Improving one's swing is one of the ways golfing enthusiasts can increase their proficiency. There are special clubs, weights, video tapes and many other techniques for utilization during practice rounds or driving range sessions. The extant learning devices are primarily based on the feedback the golfer receives from them and thus learn the correct technique while avoiding wrong techniques.

One of the more subtle difficulties encountered by most golfers is the timing and speed of the swing. There is no absolutely correct tempo or speed of the swing. Trial and error is the only reliable way to discover the swing that produces a long, straight shot. Once that discovery is made the golfer needs to development muscle and tempo memory in order to repeat the swing and hence replicate the desired result.

One device known in the art that helps the golfer in some sense memorize and repeat the same golf swing that produces the desired result is a glove worn on the hand of the user as described in U.S. Pat. No. 5,733,201 by the same inventor. While the glove unit is a highly accurate and desirable device, it has the inherent drawback that it is in the form of a glove. The glove is not interchangeable to allow use by either a right-handed or left-handed golfer, there is significant variation in sizing and the glove can not be made as durable as the monitoring instrumentation attached to it.

SUMMARY OF THE INSTANT INVENTION

The instant invention is directed to a training device in the form of a wrist watch. The timing or tempo of a golfer's club swing is detected by a motion sensor or accelerometer housed in a watch casement. The elapsed time of the swing and club head speed are captured via activation at the beginning of the swing and termination of the time interval is determined as being at the point of contact with the ball. The elapsed time in milliseconds and the club head speed in miles per hour are digitally displayed on the watch face. The grip pressure is measured by an electric piezo like sensor, deployed behind a metal plate on the back of the watch. The watch is tightly secured to the wrist and in contact with the pulse pressure points. As the golfer's grip tightens, the sensor registers grip pressure in a positive range and conversely, as grip pressure loosens, the sensor registers in a negative range.

The invention possesses memory functions which allow the user to save the tempo and speed and grip pressure parameters following the swing that produces good results. In other words, on a driving range the golfer hits a long, straight shot. He simply presses the SAVE button on the invention and the parameter values will be retained in memory. These values become the benchmark values against which subsequent golf swings are compared. Should the values on the subsequent swing differ from those of the parameter settings, an error message in the form of an audible signal will be activated.

The range of tolerance before an error message is generated is also variable. The invention possesses a HANDICAP setting. Should the user set a very low HANDICAP, say approaching zero, the error message or signal will be generated by very slight departure from the parameter values. Conversely, higher HANDICAP settings will be more forgiving with a larger margin of error before generating a signal.

Thus the utility of the invention is to enhance muscle memory, helping the golfer learn to groove his or her swing. The nearly instantaneous feedback makes the user aware that they have either repeated their best swing or failed to do so. As with most motor skills, the greatest proficiency is achieved through repetitive trials. The error factors in statistically significant trials will generally distribute normally. This invention seeks to heighten and narrow that distribution (modal) by providing instantaneous information ideally leading to the reduction of error signals over repeated trials.

BRIEF DESCRIPTION OF THE DRAWINGS

FIG. 2 is a schematic representation of one design of a monitoring unit of the instant invention including the display area.

DESCRIPTION OF A PREFERRED EMBODIMENT

Figure 1A:
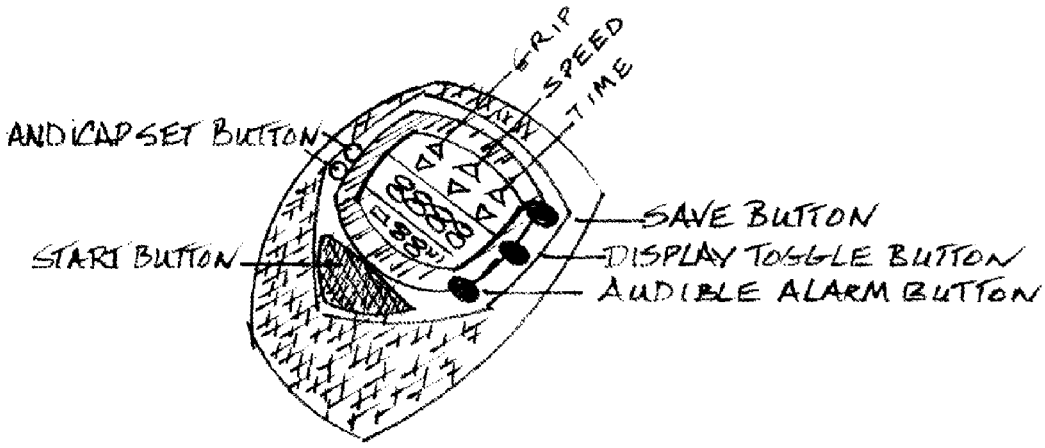
FIG. 1 is a schematic drawing of one embodiment of the training device of the instant invention. Each of the operator controls are identified.
Figure 1B:
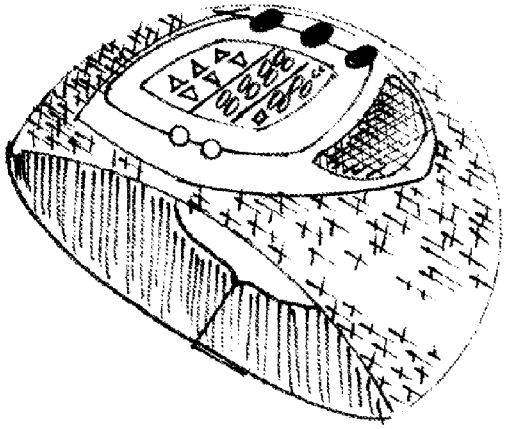

FIG. 1 is a schematic representation of one embodiment of the instant invention. In particular, this configuration includes a rubberized, vinyl wrist strap and a metal monitor housing or instrumentation package. The electronics package inside the housing can be removed from the strap if desired. The controls are operated by the user in the following sequence. The START BUTTON (100) activates the instrument. Next the user sets his or her HANDICAP (104) indicating their particular skill level. For example, a handicap close to "00" would indicate a high level of golf proficiency. As the value of the handicap setting is increased, approaching "99" the user's skill level is assumed to decrease. Functionally this translates to a highest level of precision or exactness required of the "00" handicap user or Scratch Golfer as opposed to a more forgiving standard the higher the handicap.

The AUDIBLE ALERT ON/OFF BUTTON (101) activates the signaling device that will sound or buzz when the user fails to replicate the swing he or she has saved following the swing that produced the results needed to replicate the saved or benchmark swing. In particular, on a driving range, a golfer will hit a sequence of golf shots. Presumable, only longest and the straightest one of those shots will be saved. The user accomplishes this by simply pressing the SAVE BUTTON (103). The data from the saved shot is compared to values recorded by the invention on subsequent shots. Departures from the saved values are detected and the audible signal is activated. (101)

The DISPLAY TOGGLE BUTTON (102) is manually pressed at two different stops. A lighter touch activates the display of the tempo or elapsed time of the swing variable in milliseconds. The timing sequence for the interval begins with the start of the back swing and finishes when the club end first begins to slow drop or decelerate. Theoretically and empirically this is precisely at the instant of impact of the club head with the ball. When the user depresses the DISPLAY TOGGLE BUTTON (102) with slightly more pressure, the maximum club head speed will be displayed in miles per hour.

FIG. 2 is a representation of the LCD layout of the instant invention. Reference is made concurrently to FIGS. 1 and 2. As noted in the legend accompanying FIG. 2, the Speed and Time Arrows (200) indicate whether the trial shot, that is, shots or swings taken after the reference or benchmark swing has been saved, replicate the benchmark shot. The Arrows (200) indicate the direction of the error or deviation from the presetting, in either above (plus) the presetting or below it (minus).

The actual obtained values for club head speed and for elapsed time of the shot are displayed on the face of the LCD or watch face. (201) The speed is expressed as miles per hour. The calibration of the speed was achieved through field trials where several extant speed measurements instruments, mostly radar based, were used to validate the accuracy of the instant invention. A reliability coefficient of 0.90 was used as final assessment criterion.

As pointed out the HANDICAP SET (202) is user designated. As the user's skill level improves, and the HANDICAP SET (202) approaches 00, the margin of error can be diminished to the point where virtually no deviation from the benchmark setting can be detected. Conversely, the beginner might care to set the HANDICAP SET (202) at a high or mid range point range, say 15 to 30. At these settings the invention allows a wide margin or error before activating the AUDIBLE ALERT SIGNAL. (204). The volume on the AUDIBLE ALERT SIGNAL (204) can be adjusted to accommodate the ambience. Alternatively, the volume can be turned off while the AUDIBLE ALERT SIGNAL volume indicator will illuminate, indicating the user has executed a swing outside the parameter settings of the benchmark swing.

Finally there is a BATTERY LIFE INDICATOR (203) on the LCD. As the 3 volt lithium battery runs low on charge, the user will be able to determine from visual inspection when the battery needs changing. Several features are programmed into the instant invention to conserve battery life. For example, when no swinging motion is executed by the user after a benchmark swing has been saved for 30 seconds, the device automatically goes into sleep mode. Only the memory of the pre-settings are retained while no other functions will be operational until the START BUTTON (100) is pressed again.

Figure 3:
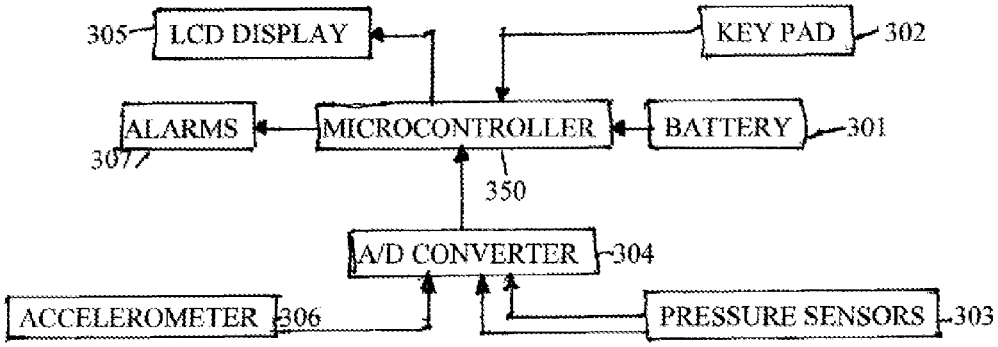
FIG. 3 is a block diagram of one embodiment of the monitoring circuit of the instant invention.

Referring now to FIG. 3, there is shown a block diagram of the swing monitor system 300 of the instant invention. This system is disposed within a suitable housing to form the instrumentation package described in FIG. 1 supra.

In this embodiment, the microcontroller 350 is the basic operational and computational component of the system. The microcontroller 350 can be any type of microprocessor such as a low power CMOS chip of any conventional design.

Microprocessor: There are several choices available from the "off the shell" stock of chips. Our requirements are for 16 bit CPU with enough memory to support our sophisticated software programs. Some models come ready equipped or preloaded with Analog to Digital Converters (A/D Converter) 304.

Power Supply 1 and 2: 301. Two 3 CR2025 lithium long life batteries power the invention. As the technology of batteries improves, driven by the demands from the high tech fields of hand held computers and telecommunications devices, longer lasting, and more powerful miniature batteries will become available.

A key pad 302 is connected to the controller 350 in order to apply selective control signals such as limit adjustments, sensitivity adjustments and the like to the operation of the circuitry. The keypad 302 can also include the reset buttons described supra. The keypad 302 can be included in the housing for the package in FIG. 1 noted above. The chronometer 303 is representative of a suitable timing or tempo measuring device. The chronometer is connected to an A/D converter 304 of conventional design. A typical A/D converter device has an 8-bit resolution and converts the analog signal from the timing device to a digital signal which is then supplied to the microcontroller 450 and may be contained in the micro-controller.

A suitable display 305, for example a liquid crystal display (LCD), is connected to receive output signals from the microcontroller 350. Display 305 represents one (or more) of the displays 201 and 202 shown in FIG. 2. The LCD display 305 is of typical design but may be custom made in order to provide any desirable display information such as that shown and described relative to FIG. 2. Of course, the display 305 can be an LED display or any other type of display which is of suitable size and within suitable power parameters.

As noted, an accelerometer 306 can be housed in a wristwatch case along with the other devices. The accelerometer 306 can be included in a unitary package along with all of the other materials and components of the system. One such accelerometer is the ADXL202 by Analog Devices which is two directional and, therefore, capable to measuring acceleration in both positive and negative ranges. In this system, the back-swing will be registered in the negative range while the down-swing will register the acceleration of the club head. At the point of contact with the ball, maximum club head in units of MPH will be attained, stored in memory and selectively displayed. The club head will decelerate on the follow through.

Typically, the accelerometer is of conventional design and is aligned with the direction of the swing. The accelerometer measures the force of the swing usually within an acceleration rate of 0 to +/−5 g's.

The accelerometer 306 also produces an analog electrical signal which is supplied to A/D converter 304 for conversion into a digital signal. This digital signal is presented to the microcontroller 350. The signal generated by the accelerometer then is converted to a reasonably accurate approximation of the club head speed which is provided at display 305.

The microcontroller 350, in addition to supplying the signals to the display 305, also can supply signals to alarms 307 mounted in the instrumentation package 224. The alarms can be either audible or visual (or both). The audible alarm can take the form of a buzzer which alerts the golfer to an improper swing in terms of departures from the preset values or parameters saved in memory The pressure sensors 303 are electric piezo type sensor strips encased in the instrument package. The muscles and tendons in the wrist at the pulse point expand and contract as the hand's grip tightens and loosens. A discriminating electrical signal is transmited first to the A/D converter and then to the microprocessor. Up to five distinct grip pressure readings are captured in a golf swing. The arithmetic mean is computed and that value is displayed and/or saved in the memory.

Activation of the instrumentation package occurs when the device is turned on at the START BUTTON 100. There are links between the chronometer 303 and accelerometer 306 such that at the instant the accelerometer 306 registers motion, the chronometer 303 starts the timing sequence.

The timing or tempo measurement takes place during the interval from back-swing to contact with the ball. Field tests have demonstrated that maximum club head speed is registered at the moment of contact between the club head and the ball. At this instant the timing device stops running and records and displays the elapsed time from the point when the golfer first begins the back swing and ends takes hold of the club when contact is made with the ball.

The accelerometer is also activated on the back-swing. The speed of the club head, which is derived from a semi-log transform of hand speed, is measured in negative ranges until the top of the swing. In the downswing, the club head gains speed or momentum until contact with the ball, at which instant, deceleration begins. The device records and displays the maximum speed obtained.

Basically, the invention is recording non-discrete, continuous data of the type depicted in a curve. For example, the path of the club head through a range of speeds. This is also the case with respect to the grip pressure measurement. The invention converts that analog data to a digital format, assigns meaningful values to the converted digital date, i.e. GRIP, SPEED and TIME, and stores and displays those digital values.

Figure 4:
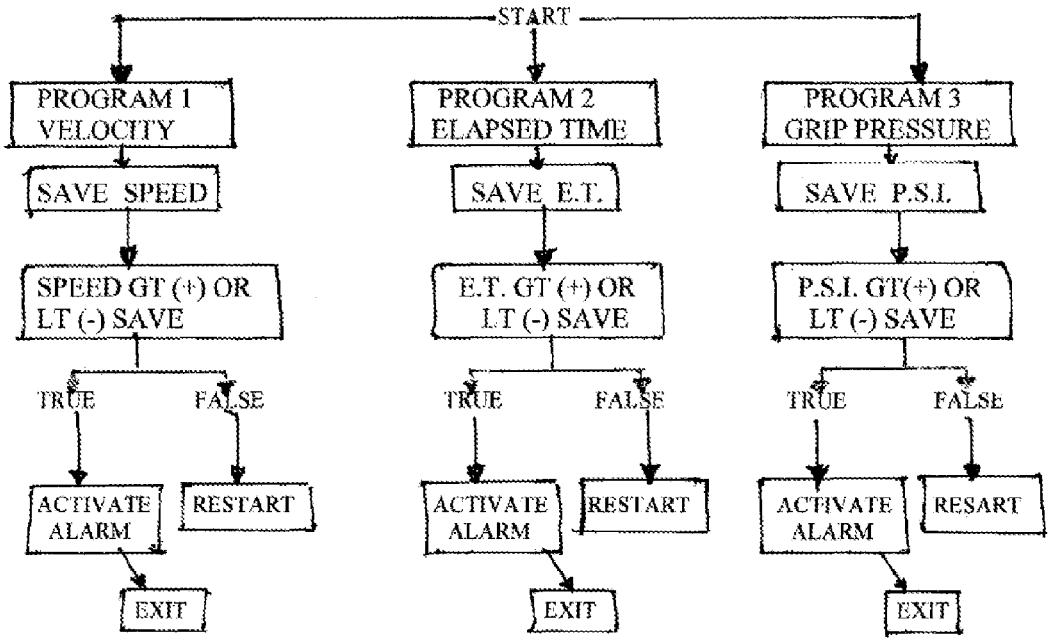
FIG. 4 is a flow chart of the operation of the system shown in FIG. 3.

FIG. 4 is a schematic representation of a flow chart for the operation of the circuit. In one embodiment, this flow chart is representative of the "fuzzy" logic operation of the microprocessor 350. Typically, the flow chart shows two related subroutines processed by microcomputer 350. Program #1 is related to the operation of the accelerometer 306. This program supplies the value of the club speed head in SPEED. to display 305. The program is reset by the SAVE BUTTON 103. The speed or velocity of subsequent swings is compared to that stored in memory. If the speed is within the range of tolerance determined by the HANDICAP SET 104, no error signal is generated. If, on the other hand, the club speed is significantly different than the saved parameter, the AUDIBLE ALERT 101 signal is activated Program #2 measures the elapsed time of the golf club swing and drives the display 327. This Program is logically identical to Program #1. Both Programs loop back to START when the START BUTTON 100 is pressed. The preset values for both the speed and the elapsed time remain in memory until they are reset with the SAVE BUTTON 103.

Program #3 measures grip pressure and is logically identical to the previous two

Operation of the Shotwatch

In operation the user turns the power on by pressing the START BUTTON 100. Next the HANDICAP is set. Initially the handicap window will display "00." The range of values are from "01" to "40" for the HANDICAP SET BUTTON. When the value displayed in Setting the handicap value establishes the range of tolerances for all subsequent measurements. (High handicap golfers will not be able to exactly replicate their swing on successive tries, while low handicap and scratch golfers will only vary their swing slightly or not at all on repeated swings The user can set one or two of the variables being monitored. Having set one or two of the variables of the desired swing, the monitor will alert the user to deviations from the preset values. A flashing red light immediately below the SPEED and/or TIME labels will tell which parameter deviations exist. (The range of tolerances for the deviations is determined by the individual handicap.)

To change the values saved in the system, simply press the START button. Otherwise, saved values for the MPH and ET will be retained even if the instrument is turned "Off", i.e. the unit is in the "sleep" mode. Therefore, the next time the unit activated, the last settings will appear.

A "sleep mode" is included to conserve energy when the device is inactive for sixty seconds. In the "sleep mode" the memory retains the last values stored. In accordance with this invention, the application of over swing or under swing is indicated by sounding an alarm 407 noted above. Through the use of this training device, the golfer can learn to avoid or eliminate any variation from the swing that gives the "best results.". By using this golf band as a training device, the golfer can ultimately "memorize" the type of golf swing which is desired to optimize the playing of the game. The utility of this invention is derived from learning theory which in its simplest form attempts to get the learner to repeat what he or she does right, and secondly be made aware of departures or deviations from the correct action on subsequent trials.

The golfer on the driving range can use the invention with any club, wood, iron, wedge or putter. Following a swing he or she wishes to repeat, the device will remember the values obtained. For example, one is hitting with a driver. Immediately after a long, straight shot, the golfer merely presses the SAVE BUTTON and the variables will be placed in memory.

A signal will be transmitted, either a buzz or a red light when the golfer deviates from those preset values on the next swing or swings. Depending on the golfer's competence as determined by the Handicap setting which can take on values between 00 and 40, a very good or scratch golfer with a handicap of 00, will get an error signal with only minute departures from the preset values, while higher handicap golfers will have a much greater margin or error.

Thus, there is shown and described a unique design and concept of a golf training strap. While this description is directed to a particular embodiment, it is understood that those skilled in the art may conceive modifications and/or variations to the specific embodiments shown and described herein. Any such modifications or variations which fall within the purview of this description are intended to be included therein as well. It is understood that the description herein is intended to be illustrative only and is not intended to be limitative. Rather, the scope of the invention described herein is limited only by the claims appended hereto.

The invention claimed is:

1. A swing monitoring watch comprising:

a piezo sensor;

an accelerometer;

monitoring circuitry configured to receive signals from the piezo sensor and the accelerometer and configured to determine, based at least in part on one or more received signals, a swing speed of a swing, an elapsed time of a swing and a grip pressure of a swing;

a display configured to display information determined by the monitoring circuitry; and a wrist strap for mounting the piezo sensor, the accelerometer, the monitoring circuitry and the display to a wrist wherein the mounting of the piezo sensor provides for generation of signals responsive to changes in circumference of the wrist caused by muscle movement.

2. The swing monitoring watch of claim 1 further comprising circuitry for determining a skill level based at least in part on information determined by the monitoring circuitry.

3. The swing monitoring watch of claim 1 comprising an analog to digital signal converter.

4. The swing monitoring watch of claim 1 comprising a micro-processor.

5. The swing monitoring watch of claim 1 wherein the display comprises a liquid crystal display.

6. The swing monitoring watch of claim 1 comprising alarm means electrically connected to said monitoring circuitry.

7. The swing monitoring watch of claim 6 wherein the alarm means comprises alarm means configured to selectively provide an audible alarm signal.

8. The swing monitoring watch of claim 6 wherein the alarm means comprises alarm means configured to selectively provide a visual alarm signal.

9. The swing monitoring watch of claim 1 comprising switch means for selectively controlling the operation of said electronic monitoring circuitry.

10. The swing monitoring watch of claim 9 wherein the switch means comprises switch means configured to reset switches connected to said electronic monitoring circuitry and to said display.

11. The swing monitoring watch of claim 1 comprising position marking means on the front of said watch to assist in the positioning of a golf club relative to said strap during a golf swing.

12. The swing monitoring watch of claim 1 wherein the accelerometer comprises a two-axis accelerometer that provides signals to the monitoring circuitry to determine hand speed of a golf swing and elapsed time of a golf swing from take-away or backswing, to contact between a golf club and a golf ball.

13. The swing monitoring watch of claim 1 wherein the piezo sensor comprises a strain gauge configured to provide for the generation of signals responsive to changes in circumference of the wrist caused by muscle movement, the generation of signals for registering, recording and displaying a user's grip pressure exerted on a handle or grip of a golf club during a swing.

* * * * *